US007471907B2

(12) United States Patent
Berg et al.

(10) Patent No.: US 7,471,907 B2
(45) Date of Patent: Dec. 30, 2008

(54) DEVICE AND METHOD FOR ELECTROPHORETIC LIQUID DEVELOPMENT

(75) Inventors: Martin Berg, München (DE); Volkhard Maess, Pliening (DE); Martin Schleusener, Namborn (DE)

(73) Assignee: Oce Printing Systems GmbH, Poing (DE)

( * ) Notice: Subject to any disclaimer, the term of this patent is extended or adjusted under 35 U.S.C. 154(b) by 363 days.

(21) Appl. No.: 11/366,254

(22) Filed: Mar. 2, 2006

(65) Prior Publication Data

US 2006/0232615 A1 Oct. 19, 2006

Related U.S. Application Data

(62) Division of application No. 10/565,250, filed on Feb. 22, 2007.

(51) Int. Cl.
*G03G 15/00* (2006.01)

(52) U.S. Cl. ..... 399/38; 399/50; 399/51

(58) Field of Classification Search ..... 399/38, 399/46, 47, 48, 50, 51, 57, 58, 59
See application file for complete search history.

(56) References Cited

U.S. PATENT DOCUMENTS

| | | | | |
|---|---|---|---|---|
| 4,411,514 | A | 10/1983 | Komori et al. | |
| 5,258,809 | A | 11/1993 | Wiedemer | |
| 6,219,516 | B1 | 4/2001 | Furst et al. | |
| 6,371,024 | B1 | 4/2002 | Scholzig et al. | |
| 6,868,246 | B2 * | 3/2005 | Takeuchi et al. | 399/237 |
| 6,876,833 | B2 | 4/2005 | Berg et al. | |
| 7,003,236 | B2 * | 2/2006 | Fujita et al. | 399/57 |
| 7,039,343 | B2 * | 5/2006 | Sasaki et al. | 399/249 |
| 7,141,346 | B2 * | 11/2006 | Teraoka et al. | 430/115 |

FOREIGN PATENT DOCUMENTS

| | | |
|---|---|---|
| EP | 0 727 720 | 12/2000 |
| EP | 1 090 756 | 4/2001 |
| EP | 1 097 813 | 5/2001 |
| EP | 0 756 213 | 12/2002 |
| GB | 2 023 503 | 1/1980 |
| WO | WO 01/92968 | 12/2001 |

OTHER PUBLICATIONS

Patent Abstracts of Japan—Publication No. 2001235945—Aug. 31, 2001.

(Continued)

*Primary Examiner*—Hoan H Tran
(74) *Attorney, Agent, or Firm*—Schiff Hardin LLP

(57) ABSTRACT

In an electrographic printing device, an image generating system generates an electrical charge image on an image carrier element. The electronic charge image is made visible by a developer station via charged ink particles, the image being subsequently transferred onto a final image medium and fixed thereon. A speed control is provided which: continuously varies speed of the image carrier element from zero up to a limit speed; adapts charge intensity of the image carrier element to its speed; adapts an exposure intensity for exposure according to the image and in a deletion exposure of the image carrier element to its speed; and keeps a supply of toner to the image carrier element constant per area.

40 Claims, 5 Drawing Sheets

OTHER PUBLICATIONS

Patent Abstracts of Japan—Publication No. 57040268—Mar. 5, 1982.
Patent Abstracts of Japan—Publication No. 09127842—May 16, 1997.
Patent Abstracts of Japan—Publication No. 10296958—Nov. 10, 1998.
Patent Abstracts of Japan—Publication No. 2002046912—Feb. 12, 2002.

* cited by examiner

DEVICE AND METHOD FOR ELECTROPHORETIC LIQUID DEVELOPMENT

RELATED APPLICATION

The present application is a divisional application related to parent application Ser. No. 10/565,250 filed Feb. 22, 2007 titled: Device And Method For Electrophoretic Liquid Development".

BACKGROUND

For single- or multi-colored printing of a recording medium (for example a single sheet or a belt-shaped recording medium made from the most varied materials, for example paper or thin plastic or metal films), it is known to generate image-dependent potential images (charge images) on a potential image medium, for example a photoconductor, which image-dependent potential images correspond to the images to be printed that are comprised of regions to be inked and regions that are not to be inked. The regions to be inked (called image positions in the following) of the potential images are made visible with a developer station (inking station) via toner. The toner image is subsequently transfer-printed onto the recording medium (also called printing substrate or final image medium).

Either dry toner or liquid developer containing toner can thereby be used to ink the image positions.

A method for electrophoretic liquid development (electrographic development) in digital printing systems is, for example, known from EP 0 756 213 B1 or EP 0 727 720 B1. The method described there is also known under the name HVT (High Viscosity Technology). A carrier liquid containing silicon oil with ink particles (toner particles) dispersed therein is thereby used as a liquid developer. The toner particles typically have a particle size of less than 1 micron. More detail in this regard can be learned from EP 0 756 213 B1 or EP 0 727 720 B1, which are a component of the disclosure of the present application. Electrophoretic liquid development methods of the cited type with silicon oil as a carrier liquid with toner particles dispersed therein are described there, in addition to a developer station made from one or more developer rollers for wetting of the image carrier element with liquid developer corresponding to the potential images on the image carrier element. The developed potential image is then transferred onto the recording medium via one or more transfer rollers.

A problem is to specify a device and a method for electrophoretic liquid development, whereby the general problem comprises various aspects that are divided up in the following into three individual problems;

a) A first problem to be solved is to specify a device and a method with which the feed of the liquid developer to the image carrier element is simplified;

b) A second problem to be solved is to specify a modularly-designed printing device with which a printing system can be achieved for the most varied, complex printing machines for professional, digital high-speed printing; and c) A third problem to be solved is to specify an electrophotographic printing device and a method with which a variable speed can be realized given constant print quality.

SUMMARY

In an electrographic printing device, an image generating system generates an electrical charge image on an image carrier element. The electrical charge image is made visible by a developer station via charged ink particles, the image being subsequently transferred onto a final image medium and fixed thereon. A speed control is provided which: continuously varies speed of the image carrier element from zero up to a limit speed; adapts charge intensity of the image carrier element to its speed; adapts an exposure intensity for exposure according to the image and adapts a deletion exposure of the image carrier element to its speed; and keeps a supply of toner to the image carrier element constant per area.

DESCRIPTION OF THE PREFERRED EMBODIMENT

Figure 1:
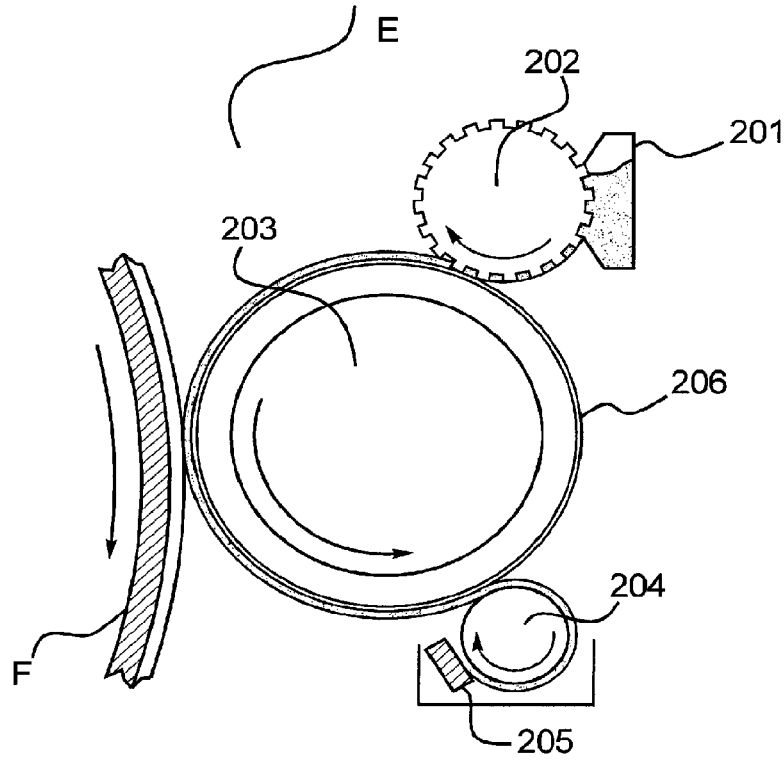
FIG. 1 is a representation of the developer station given a first position relative to the image carrier element.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Advantages of the preferred embodiment are:

- the flexible use and/or arrangement of a doctor blade chamber within the device (developer station);
- the device is suitable for application in the field of (digital) electrostatic (electrophoretic) printing methods;
- the compact design of the device, for example as a significant component of a compact printing group; and
- a device that is identical given various installation positions in a printing device, thus enabling variable printer configurations.

In order to ensure a bubble free transport of the liquid developer, it is appropriate to arrange the doctor blade chamber such that the dosing doctor blade is overflowed by liquid developer. The same result is achievable when the liquid developer is exposed to an over-pressure in the doctor blade chamber, such that the dosing doctor blade is overflowed by liquid developer.

In order to remove liquid developer exhibiting the inverse residual image from the developer unit, a cleaning device that accepts the residual image can be arranged adjacent to the developer unit. The cleaning device can comprise a cleaning roller and a cleaning element (for example a doctor blade) that strips the liquid developer from the cleaning roller.

The developer unit can be a developer belt, preferably a developer roller. The raster unit is preferably a raster roller, however can also be a raster belt.

The quantity of the liquid developer transported to the developer roller can be influenced in a simple manner via the rastering of the raster roller. It is advantageous when the raster roller exhibits a rastering that enables the transport of a volume of liquid developer of 1 to 40 $cm^3/m^2$ (with regard to the roller surface), advantageously 5-20 $cm^3/m^2$. The transport of the liquid developer via the raster roller is thus relative to the surface and thus independent of the print speed, such that the same quantity of liquid developer per areal unit is always directed to the developer roller given different printing speeds.

It is advantageous that the developer roller, raster roller and cleaning roller can rotate with constant speed ratios (surface velocities), advantageously in the ratio of 1:1:1. The movement directions of the surfaces of developer roller and image carrier element can thus be in the same direction or in opposing directions, the developer roller and raster roller can rotate in the same direction or in opposing directions, and the developer roller and cleaning roller can rotate in the same direction or in opposing directions.

In order to advantageously influence the transfer of liquid developer, a potential for specific field effect on the charged toner particles can be respectively applied at the developer roller and the image carrier element. This also applies between developer roller and cleaning roller as well as between raster roller and developer roller.

In order to furthermore advantageously influence the transition of liquid developer, it is appropriate to provide the developer roller with an elastic coating in order to achieve defined effective zones with regard to the adjacent elements. The effective zone is then created via a defined deformation of the elastic coating of the developer roller, advantageously via elastic force feed to the adjacent elements (image carrier element; cleaning roller; raster roller). An effective zone is also created by the incompressible layer of the liquid developer that establishes the separation between developer roller and image carrier element, developer roller and cleaning roller, and developer roller and raster roller.

The chamber doctor blade can comprise one chamber sitting on the circumferential surface of the raster roller, two doctor blades sealing the chamber—a closing doctor blade at the entrance of the chamber (viewed in the rotation direction of the raster roller), a dosing doctor blade at the exit of the chamber (viewed in the rotation direction of the raster roller)—and two seals laterally applied on the side boundary of the raster roller. The feed of the liquid developer into the chamber can occur via one or more inlet openings, advantageously via pumping; the removal of the liquid developer from the chamber can occur via inlet or outlet openings, whereby the inlet or outlet openings should be exchangeable depending on the installation position relative to the raster roller.

To prevent the inclusion of air bubbles in a disadvantageous installation position, (for example the dosing doctor blade lies above the closing doctor blade in the direction of gravitational pull) and in order to be able to process higher-viscosity liquid developer (for example 1000 mPa*S), a lighter over-pressure can be generated in the chamber.

It is advantageous that the installation position of the chamber doctor blade on the raster roller is executed variably. The installation position of the cleaning direction on the developer roller can likewise be executed variably.

The use of the device as a developer station in an electrophoretic printing device is particularly advantageous. It is then particularly advantageous that the developer roller, the raster roller and the cleaning roller can be arranged at a constant angle relative to one another, such that the arrangement of the developer station is possible at various angular positions around, for example, a roller-shaped image carrier element without changing the association of developer roller, raster roller, cleaning roller relative to one another (i.e. developer stations of the same design can be arranged without alteration at different positions along the image carrier element). This advantage is increased further in that the angular position of the chamber doctor blade on the raster roller can be varied.

Printing modules can thus be achieved that respectively comprise a developer station and an image carrier element that can be arranged at various angular positions along a deflected recording medium, whereby the arrangement of chamber doctor blade, raster roller and developer roller relative to one another is sustained in the developer station. The printing module can additionally comprise a transfer roller that, for example, transfers the toner images from the image carrier element to the recording medium.

Advantages of the preferred embodiment are:

- the speed of the development can be flexibly adapted depending on the usage purpose, start, stop via feed of the liquid developer via the raster roller;
- the simple design (for example only three rollers) enables a compact structural shape and therewith compact printing group designs; and
- the dosing ratio of a chamber scraper is largely viscosity-independent in a large range (0.5-1000 mPa*s) and thus effects
  - a stable processing of different concentrations of the liquid developer and thus high process stability; and
  - the usage of identically-designed developer stations for different liquid developers (for example for different applications).

As to the second problem, the printing device for printing of a printing substrate is comprised of a combination of one or more printing groups with a common printing substrate guidance group as well as with a central control group for coordination of the workflows in the printing groups, in the printing substrate guidance group, as well as in possible connected apparatuses of the printing substrate pre- or post-processing.

The combination of essentially structurally identical (identical in cross-section arrangement, depth corresponding to that of the printing substrate width to be processed), compact and easily manipulable printing modules into a printing device with respectively different printing substrate guidance group, both for "Continuous Feed" (printing on continuous printing substrate web) and for "Cut Sheet" (single sheet or sheet printing), enables the flexible design of the most varied printing devices: from black-and-white (black/white) simplex to black-and-white duplex, YMCK (yellow, magenta, cyan, black) full color simplex to complex, full color duplex printers with four or more printing groups on each printing substrate side. In addition to the uncomplicated design of the complex printing devices at the manufacturer, the comparably easy retrofit and upgrade capability of existing printing devices at the client is advantageous. The use of structurally-identical modules, in particular in the printing groups, additionally enables the cost-effective manufacture via large-scale manufacturing.

Advantageous properties of the printing groups and printing substrate group are:

larger speed range (for example 0.3 to 3 m/s);

printing substrate width advantageously up to at least 22 inches, however narrower is possible;

variable speed during the running printing operation in the overall speed range;

compact structural shape of the printing groups (for example (50×100) $cm^2$ cross-section, depth corresponding to printing substrate width); and easy handling capability of the printing groups given the installation and demounting in existing printing devices (retrofitting or, respectively, upgrading), if applicable via suitable auxiliary printing devices.

As to the third problem, the printing device has the advantage that a change of the printing speed is possible in a continuously variable manner and in a large range without reduction of the print quality.

According to the preferred embodiment, a printing device is provided that is comprised of an image-generating system that generates an electronic charge image on an image carrier element (for example photoconductor), which electronic charge image is made visible by means of a developer station via charged ink particles (toner particles) and is subsequently transferred onto a recording medium or final image medium (for example paper) and fixed on this.

Given such a printing device it is possible to vary the speed of the image carrier element continuously from 0 to the limit speed;

to adapt (with regard to information location and energy per area) the electronic character generation and, if applicable, the charge intensity of the speed of the image carrier element such that (for example in the electrographic process) the charge image (with regard to form and potential values) is always created in the same manner independent of the speed of the image carrier element; and to implement the development of the charge image with a charge image that allows it to develop the signal distribution on the image carrier element independent of its speed (in the electrographic process, this means that the same potential distributions on the image carrier element always generate the same toner distributions on the charge image during the development process).

For the case that the development of the charge image is not entirely independent of the speed of the image carrier element, the process parameters (for example photoconductor potential, light energy, auxiliary potential over the developer gap, toner concentration or auxiliary potentials for transfer onto the final image medium) can be varied such that the toner image deposition on the image carrier element or the final image medium is nearly identical given different velocity. The parameters to be influenced are advantageously to be coupled with one another via one or more regulatory processes.

A development method is advantageously used that naturally generates an independent toner deposition up to the limit speed of the image carrier element. This occurs, for example, via a liquid development in which fine toner particles (advantageously approximately 1 μm in diameter or smaller) are dispersed in a high-ohmic carrier fluid (for example silicon oil), whereby the concentration of the toner particles can be selected so high that so many toner particles are located in a thin developer gap (advantageously 5 to 10 μm) that the desired inking (optical density or ink density) on the image carrier element is created given complete (or nearly complete) deposition of all toner particles located in the developer gap. It is furthermore a requirement for the function that the movement capability of the toner particles in the development gap is at least so large that, during the residence duration of the toner particles in the developer gap, all (or almost all) toner particles under the influence of the electrical field strength existing over the regions of the image carrier element to be inked completely traverse the developer gap and are deposited on the regions to be inked on the surface of the image carrier element and, under the influence of the electrical field strength existing over the regions of the image medium that are not to be inked, are not or are nearly not, deposited on the surface of the image medium.

In this method, the respective achievable maximum inking can be pre-selected or set in connection with the targeted adjustment of the toner concentration in the developer fluid. In this printing process, a specifically set maximum inking can thus be held constant given variable printing speed.

Such a developer station can comprise a developer roller that transports a liquid developer past the image carrier element such that the toner deposition on the image carrier element is independent of its speed.

The developer station can be executed such that a developer roller is provided adjacent to the image carrier element, which developer roller directs the liquid developer comprising toner particles past the image carrier element and from which toner particles cross over to the image carrier element corresponding to the previously-generated charge images, a raster roller in whose rastering the liquid developer is transported to the developer roller is arranged adjacent to the developer roller, a chamber doctor blade comprising a dosing doctor blade is arranged adjacent to the raster roller, from which doctor blade chamber the raster roller accepts the liquid developer via the dosing doctor blade whose position relative to the raster roller is adjustable and that is designed such that the dosing doctor blade is overflowed by liquid developer.

The overflow can be achieved based on the gravitation of the liquid developer or via utilization of over-pressure.

It is advantageous that the quantity of the liquid developer transported by the raster roller can be established via the rastering of the raster roller. The transport of the liquid developer via the raster roller is thus relative to the area and thus independent of the print speed, such that the same quantity of liquid developer per area related unit is always directed to the developer roller given different printing speeds.

It is advantageous when the raster roller exhibits a rastering that enables the transport of a volume of liquid developer from 1 to 40 $cm^3/m^2$ (corresponding to the roller surface), advantageously 5-20 $cm^3/m^2$.

It is furthermore advantageous when the developer roller comprises an elastic coating that is in contact with the image carrier element and with the raster roller.

The doctor blade chamber can be a chamber situated on the circumferential surface of the raster roller, with two doctor blades sealing the chamber, namely a closing doctor blade at the entrance of the chamber (viewed in the rotation direction of the raster roller), a dosing doctor blade at the exit of the chamber (viewed in the rotation direction of the raster roller), and with two seals laterally applied at the edge of the raster roller. The feed of the liquid developer into the chamber can thus occur via one or more inlet openings, advantageously via pumping, and the removal of the liquid developer from the chamber can occur via inlet or outlet openings.

A) First Aspect of the Preferred Embodiment

A Device for Transport of Liquid Developer to an Image Carrier Element Given Electrophoretic Digital Printing For design of a developer station E according to FIG. 1, the developer station E comprises:

- a developer roller 203 with an elastic coating 206; multiple developer stations can also naturally be provided;
- a raster roller 202 with a rastering made up of depressions (cups) arranged thereupon; a plurality of raster rollers can also be provided; the rastering can be executed differently depending on the application case;
- a doctor blade chamber 201 that is variable in terms of its position relative to the raster roller;
- a cleaning device with a cleaning roller 204 and a cleaning element 205.

The developer roller 203 contacts an image carrier element F, for example a photoconductor on a photoconductor belt or a roller with a photoconductor layer arranged thereupon. Furthermore, a transfer roller 121 (FIG. 5) can be provided for transfer of the toner image inked with fluid toner from the image carrier element F onto a belt-shaped recording medium 1 or a sheet-shaped recording medium.

A liquid developer with ink (toner particles) distributed therein, which liquid developer is suitable for electrophoretic development, can be used as it is known, for example, from EP 0 756 213 B1 or EP 0 727 720 B1.

The feed of the liquid developer for inking with toner particles of the image carrier element F according to the image occurs over the doctor blade chamber 201 and the raster roller 202 to the developer roller 203. The cleaning of the inverse residual image from the developer roller 203 in turn occurs via its transfer to the cleaning roller 204 and removal of the liquid developer from the cleaning roller 204 via a cleaning element 205 (for example a doctor blade). From the cleaning device 204, 205, the removed liquid developer can be transferred back to a reservoir for the liquid developer (not shown).

The developer roller 203, the raster roller 202, and the cleaning roller 204 rotate in an advantageous manner with constant speed ratios relative to one another (surface velocities), advantageously in a ratio of 1:1:1. The rotation direction of the developer roller 203 and of the medium element F can be in the same direction or in opposite directions; those of the developer roller 203 and of the raster roller 202 as well as of the developer roller 203 and of the cleaning roller 204 can be in the same direction or in opposite directions. Defined potentials for targeted field effect on the charged toner particles can be applied to them.

The developer roller 203 has an elastic coating 206 and is in contact with the image carrier element F, with the raster roller 202 and with the cleaning roller 204.

The raster roller 202 is adapted in terms of its rastering for the transport of a volume of liquid developer from 1 to 40 $cm^3/m^2$ (relative to the roller surface), advantageously 5-20 $cm^3/m^2$.

The transport of liquid developer is additionally relative to the area and thus independent of the printing speed, i.e. the same quantity of liquid developer per areal unit of the developer roller 203 can always be supplied given different printing speeds.

The formation of defined effective zones for the transfer of liquid developer between developer roller 203 and image carrier element F, developer roller 203, and cleaning roller 204 and developer roller 203 and raster roller 202 can be achieved in varying manners:

- via defined deformation of the elastic coating 206 of the developer roller 203, advantageously via elastic force delivery to adjacent elements such as, for example image carrier element F, raster roller 202 or cleaning roller 204;
- via the incompressible layer of the liquid developer between developer roller 203 and image carrier element F, developer roller 203, and cleaning roller 204 or developer roller 203 and raster roller 202.

Figure 4:
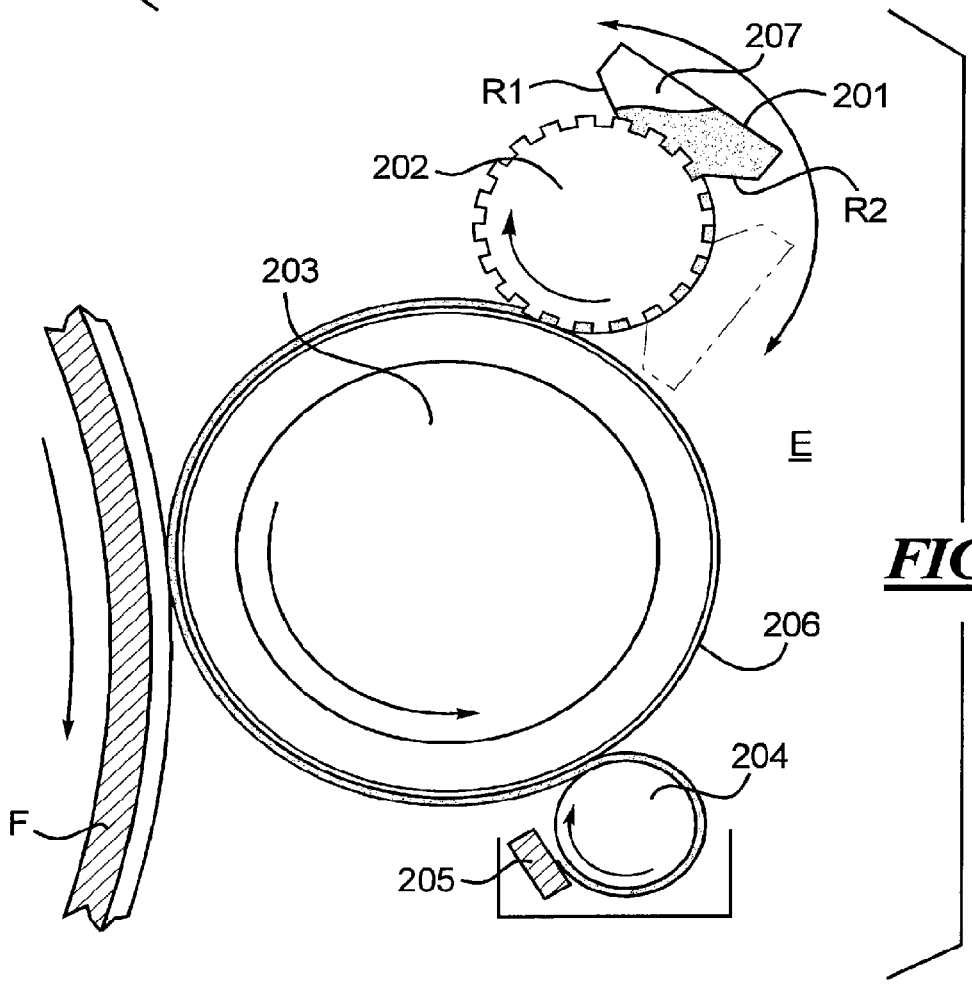
FIG. 4 is a representation of the developer station given a different arrangement of the chamber scraper relative to the raster roller.

Design and Arrangement of the Doctor Blade Chamber 201, in Particular According to FIG. 4

The doctor blade chamber 201 for offset printing is known from Kipphan, Handbuch der Printmedien, Springer Verlag, 2000. Its use for electrophoretic digital printing given different positions of the developer station 200 relative to the image carrier element F results from FIGS. 1 through 4.

The doctor blade chamber 201 is a chamber 207 situated on the circumferential surface of the raster roller 202, which chamber 207 is sealed by two doctor blades (the closing doctor blade R1 at the entrance of the chamber as viewed in the rotation direction of the raster roller 202 and the dosing doctor blade R2 at the exit of the chamber 207 as viewed in the rotation direction of the raster roller 202) and two seals for sealing at the lateral edge of the raster roller 202 (not visible in the Figures). The feed of the liquid developer into the chamber 207 of the chamber doctor blade 201 can occur via one or more inlet openings, advantageously via pumping. The removal of the liquid developer from the chamber 207 (for example advantageously for better mixing of the liquid developer) and the emptying of the chamber 207 can occur via either inlet or outlet openings.

Figure 2:
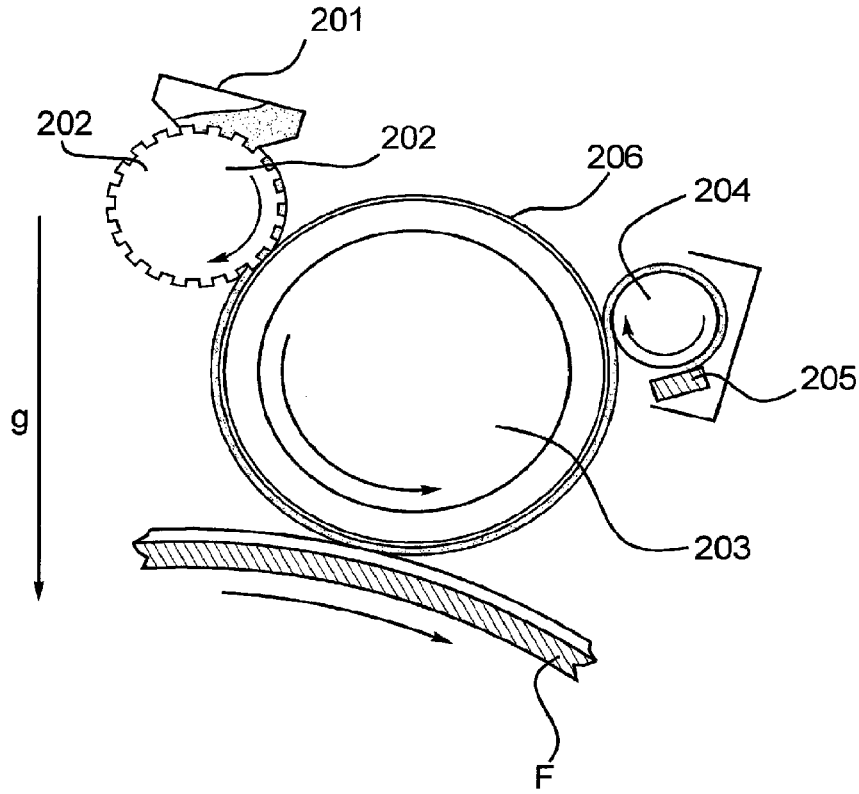
FIG. 2 is a representation of the developer station given a second position relative to the image carrier element.
Figure 3:
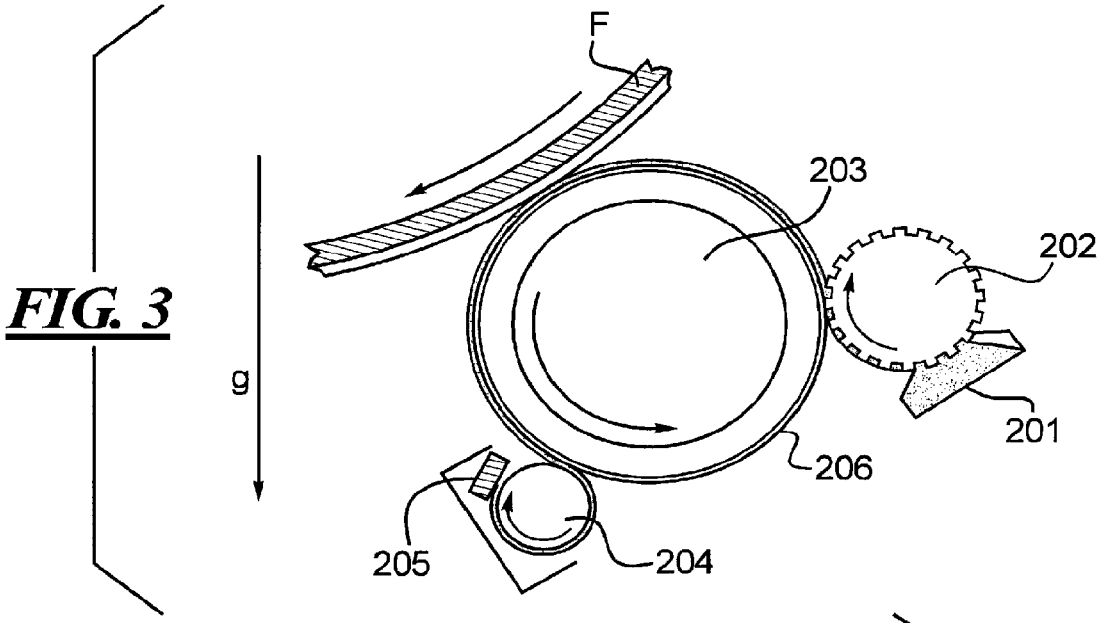
FIG. 3 is a representation of the developer station given a third position relative to the image carrier element.

An exchange of the inlet or outlet openings depending on the installation position of the doctor blade chamber 201 (FIG. 2, FIG. 3, FIG. 4) is thereby possible (in FIGS. 2 and 3, g designates the effective direction of gravity and therewith its influence on the liquid level in the doctor blade chamber 201).

The angular position of the doctor blade chamber 201 relative to the raster roller 202 is thus limited in that the dosing doctor blade R2 must always be located below the surface of the liquid developer (this serves for air bubble-free filling of the cups of the rastering of the raster roller 202).

The generation of slight over-pressure in the doctor blade chamber 201 can optionally be used in order to keep the dosing doctor blade R2 below the fluid surface. This solution is moreover suitable for processing of higher-viscosity liquid developer (for example 1000 mPa*s).

The installation positions of the doctor blade chamber 201 relative to the raster roller 202 are selectable, as FIG. 4 shows. The raster roller 202 together with the doctor blade chamber 201 can be arranged relative to the developer roller 203, depending on the installation position of the developer roller 203, such that the dosing doctor blade R2 is overflowed with liquid developer (FIGS. 1 through 4). The following embodiments are advantageous:

- one embodiment provides a constant angle between developer roller 203, cleaning roller 204 and raster roller 202 and enables an arrangement at various angles around the image carrier element F;
- an extension of the installation positions results via the additional possibility to vary the angular position of the doctor blade chamber 201 on the raster roller 202 (FIG. 4).

Figure 5:
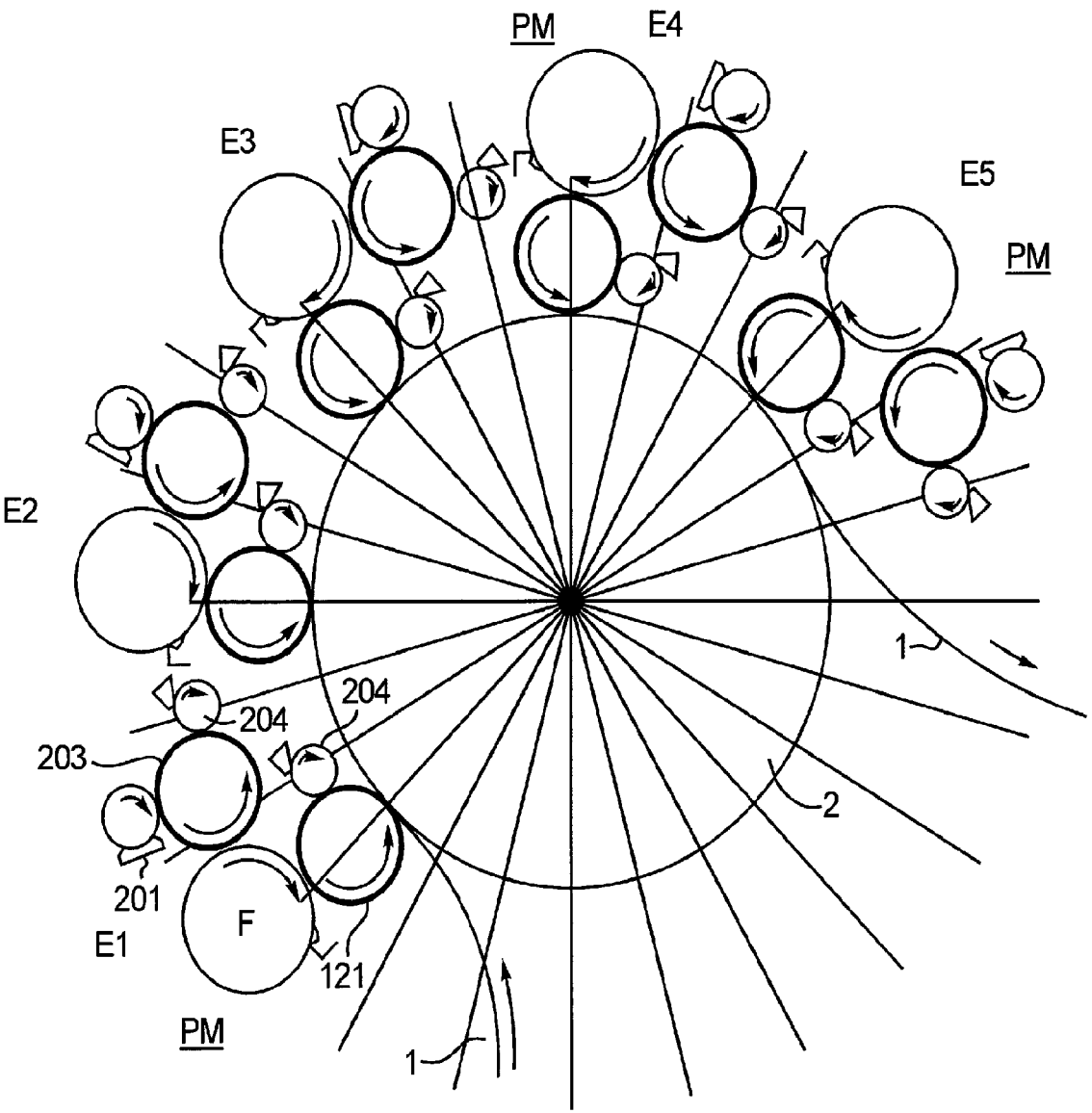
FIG. 5 is a representation of print modules with developer stations around a recording medium.

FIG. 5 shows an arrangement of a plurality of printing modules (PM), for example in a digital color printing device. Here printing modules PM, with an image carrier element F, a developer station (designated with E in FIG. 5) and a transfer roller 121 that transfers the toner image from the image carrier element F to a recording medium 1, are respectively arranged around the recording medium 1 that is deflected by a deflection roller 2. The design of the developer station E corresponding to FIGS. 1 through 4 allows structurally identical printing modules PM to be arranged at various angles in the deflection region of the recording medium 1. This is in particular achieved via a usage of doctor blade chambers 201 for feed of the liquid developer to the image carrier element F, since with this the use of the structurally identical developer stations E is possible at various installation positions (simplex, duplex, horizontal, vertical, angle range >120° given satellite arrangement) of the printing device; see FIG. 5 for a digital color printing device with multiple developer stations E1-E5 corresponding to the desired color separations. The angular range can thus be carried via additional adjustable positions of the doctor blade chamber 201 (and of the cleaning device 204, 205) via an adjustment device or via adjustable design of doctor blade chamber 201 and cleaning device 204, 205 (FIG. 2, FIG. 3).

B) Second Aspect of the Preferred Embodiment

Modularly Designed Printing Device

Figure 6:
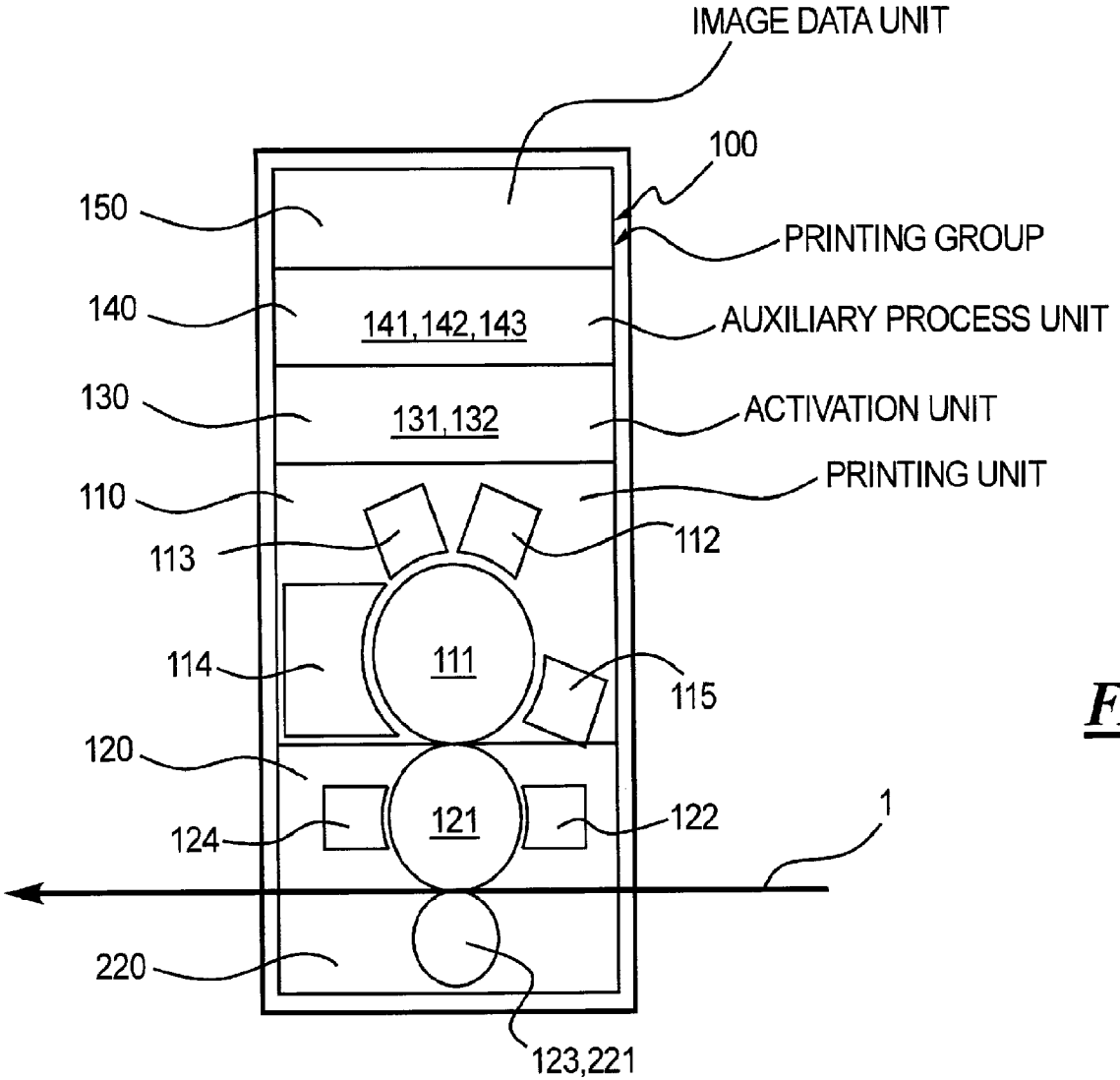
FIG. 6 shows a single printing group that can be combined with a printing device as a module.
Figure 7:
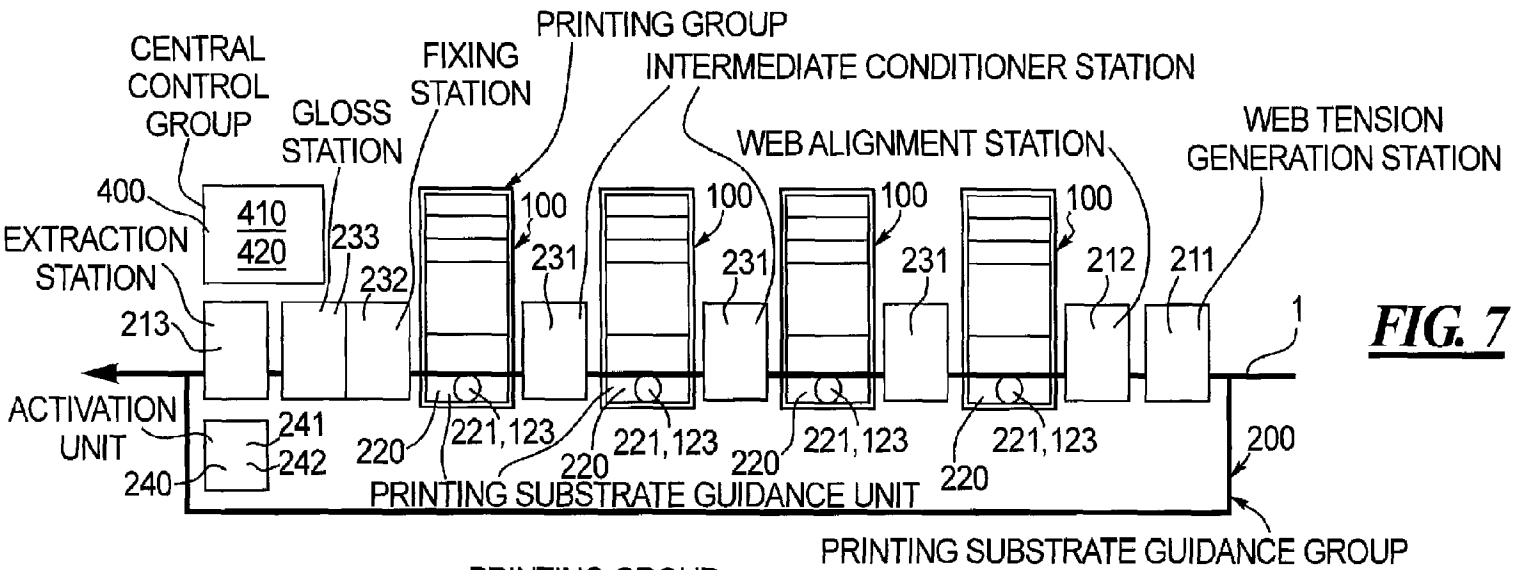
FIG. 7 shows a printing device for printing of endless printing substrate webs.

In the following, as shown in FIGS. 6 and 7, a printing system is comprised of a combination of multiple printing groups 100 arranged in succession with a common printing substrate guidance group 200. Machines of printing substrate pre- or post-processing can be connected to the printing system. A central control group 400 for coordination of the workflows in the printing groups 100 and in the printing substrate guidance group 200 is additionally provided.

The printing groups 100 are executed as modules that can be combined with one another, which modules are structurally identical, compact and easily manipulable. They can be adapted to the width of the printing substrate 1.

Design of an Individual Module=Printing Group 100

In the exemplary embodiment, the printing groups 100 are executed as electrographic printing groups as they are known, for example, from EP 0 727 720 B1. They comprise a printing unit 110 with an image generation element 111, a charge station 112, an image exposure station 113, a developer station 114 and an image generation element cleaning station 115. The image generation element 111 can comprise a photoconductor such as a photoconductor drum or a photoconductor belt. The exposure station 113 can be an LED character generator or laser. The developer station 114 can be realized as an electrophoretic liquid developer station.

For example, the developer station 114 can comprise a developer roller that transports a liquid developer past an image generation element 111 such that the toner deposition on the image generation element 111 is independent of its speed. A high-ohmic carrier fluid in which toner particles are dispersed can be provided as a liquid developer. An example of such a carrier fluid is silicon oil. The toner particles can advantageously exhibit a diameter of approximately 1 μm.

The toner concentration in the liquid developer is additionally selected such that so many toner particles are located in the developer gap between developer roller and image generation element 111 that all or nearly all toner particles located in the developer gap create the desired inking of the charge images given complete deposition. The developer gap should advantageously be 5 to 10 μm, and the mobility of the toner particles in the developer gap should advantageously be such that, during the residence duration of the toner particles in the developer gap, optimally all toner particles under the influence of the electrical field strength existing over the image generation element 111 to be inked traverse the developer gap and are deposited on the surface of the image generation element 111 to be inked.

An advantageous developer station 114 can have the following design (FIG. 4):

- a developer roller 203 is arranged adjacent to the image generation element 111 (F), which developer roller 203 directs liquid developer comprising the toner particles past the image generation element 111 and from which developer roller 203 toner particles cross to the image generation element 111 (F) corresponding to the previously-generated charge images.
- A raster roller 202 is arranged adjacent to the developer roller 203, in the rastering of which raster roller 202 the liquid developer is transported to the developer roller 203.
- A doctor blade chamber 201 comprising a dosing doctor blade R2, is arranged adjacent to the raster roller 202, from which doctor blade chamber 201 the raster roller 202 accepts the liquid developer via the dosing doctor blade R2, the position of which chamber doctor blade 201 is adjustable relative to the raster roller 202 and which chamber doctor blade 201 is designed such that the dosing doctor blade R2 is overflowed by liquid developer.

The printing group 100 furthermore comprises a transfer unit 120 made up of a transfer element 121 (advantageously a transport roller or a transfer belt) and of a transfer printing station 123 with one or more rollers. The transfer printing station 123 can be combined with a transfer printing auxiliary unit, advantageously with a corona device.

Furthermore, the transfer unit 120 can comprise a toner image conditioner station 122, advantageously a roller or a belt in contact with the transfer element 121 that, if applicable, can be electrically adjusted or tempered. The transfer unit 120 can additionally comprise a cleaning station 124 for cleaning of the transfer element 121 that, for example, is realized as a blade roller or fleece cleaner.

The printing group 100 furthermore comprises a printing group activation unit 130 with a power electronics 131 and a digital electronics 132. The power electronics 131 is associated with the motor controllers and high voltage feeds of the printing unit 110 or of the transfer unit 120; the digital electronics 132 (for example a microprocessor controller) serves for realization of process regulations in cooperation with the central control group 400 (FIG. 7), advantageously the signal processing including the interface controller to sensors of the printing unit 110 or of the transfer unit 120.

The printing group 100 can additionally comprise an additional and auxiliary process unit 140 with an ink feed station 141 and/or with a printing substrate conditioner station 142 (advantageously for paper moistening) and/or with a filter and suction station 143 (advantageously for the developer station or for the corona device).

Finally, the printing group 100 comprises an image data processing unit 150 (a controller).

Design of the Modularly-Designed Printing Device

The design of a printing device for printing of a continuous printing substrate web ("continuous feed") results from FIG. 7. Here printing groups 100 are variably connected in series in the a number corresponding to the object to be fulfilled. The printing substrate guidance group (200) is common to the printing groups 100. This printing substrate guidance group 200 comprises a printing substrate guidance unit 220 within the printing groups 100, a printing substrate web tension generation station 211 and/or a printing substrate web alignment station 212 and/or a printing substrate web extraction station 213.

The printing substrate web tension generation station 211 can be a negative pressure brake or an Omega draw that is arranged at the input of the printing system. The printing substrate web alignment station 212 can be realized as a pivoting frame that is likewise arranged at the input of the printing system. The printing substrate web extraction station 213 can be a transport roller pair that is arranged at the output of the printing system.

At least one print image conditioner unit can be provided between the printing groups 100 and/or at the output of the printing system. Respectively one unit for intermediate fixing 231 can be arranged as a print image conditioner unit between the printing groups 100; and a fixing station 232 (advantageously an IR radiation fixing or heat-pressure fixing) can be arranged at the output of the printing system. The unit for intermediate fixing or conditioning station 231 can, for example, also be omitted given a printing group 100 operating according to the electrophoretic principle.

Furthermore, a gloss station 233 can be provided at the output of the printing system.

To control the printing substrate guidance group 200, at least one electronic activation unit 240 is provided

- with a power electronics 241, advantageously for motor controllers and high voltage supplies within the printing substrate guidance group 200,
- and/or with a digital electronics 242 (for example microprocessor controller) for realization of the regulatory workflows for control or regulation of the printing substrate guidance in cooperation with the central control group 400 and/or for signal processing, including control of the interfaces to sensors of the printing substrate guidance group 200, the transfer printing unit(s) 123 as well as the print image conditioner units 231, 232, 233.

Figure 8:
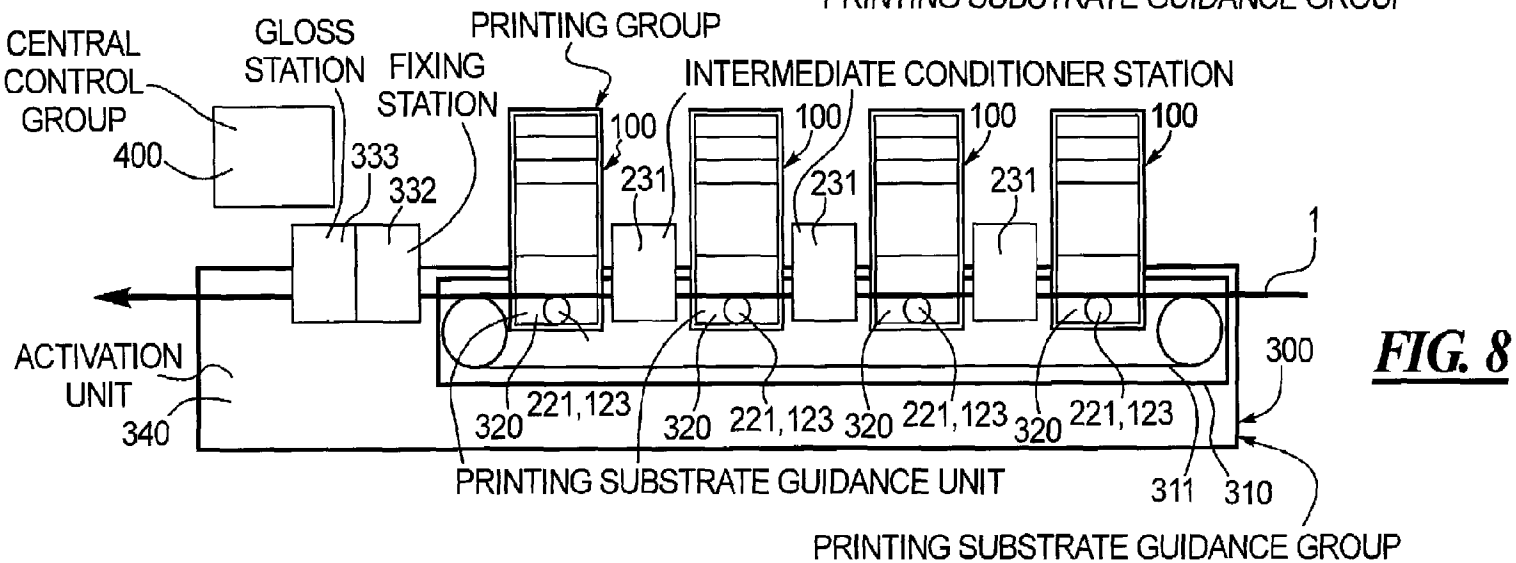
FIG. 8 shows a printing device for printing of individual sheets (cut sheet).

The design of the modular printing device for the printing of single sheets (cut sheet) can be learned from FIG. 8. In the following, only the components differing with regard to FIG. 7 are explained; the explanation regarding FIG. 7 is referred to for the identical components. It is thereby to be noted that identical associated reference characters exhibit a "3" at the beginning instead of a "2".

One difference with regard to FIG. 7 is to be seen in the printing substrate guidance group 300. This must be suitable for single sheet/sheet printing. The printing substrate guidance group 300 comprises a printing substrate guidance unit 310 with a transport belt 311 on which the individual sheets or sheets 1 rest and via which these are moved through the printing system. Furthermore, an activation unit 340 is provided whose tasks correspond to those of the activation unit 240. This is referenced.

A central control group 400 is provided both in the printing device according to FIG. 7 and in FIG. 8. This central control group 400 comprises

- a central power electronics 410,
- a central electronic printer activation unit 420.

The central activation unit 420 controls

- the interface to the printing substrate pre- and post-processing,
- and/or the interface to the printing groups 100,
- and/or the interface to the printing substrate guidance group 200 or 300,
- and/or the central printer controller for timely coordination of all workflows in the printing system as well as the entire printing path.

The central power electronics 410 comprises a mains voltage switching and safety system as well as the central power supply of the printing system.

C) Third Aspect of the Preferred Embodiment Electrographic Printing Device of Variable Printing Speed In the exemplary embodiment of FIG. 6, a printing group 100 is executed as electrographic printing groups as is known, for example, from EP 0 727 720 B1. It comprises a printing unit 110 with an image generation element 111, a charge station 112, an image exposure station 113, a developer station 114 and an image generation element cleaning station 115. The image generation element 111 can comprise a photoconductor such as a photoconductor drum or a photoconductor belt. The exposure station 113 can be an LED character generator or laser. The developer station 114 can be realized as an electrophoretic liquid developer station according to FIG. 2.

The printing group 100 furthermore comprises a transfer unit 120 made up of a transfer element 121 (advantageously a transport roller or a transfer belt) and of a transfer printing station 123 with one or more rollers. The transfer printing station 123 can be combined with a transfer printing auxiliary unit, advantageously with a corona device.

Furthermore, the transfer unit 120 can comprise a toner image conditioner station 122, advantageously a roller or a belt in contact with the transfer element 121 that, if applicable, can be electrically adjusted or tempered. The transfer unit 120 can additionally comprise a cleaning station 124 for cleaning of the transfer element 121 that, for example, is realized as a blade roller or fleece cleaner.

The printing group 100 furthermore comprises a printing group activation unit 130 with a power electronics 131 and a digital electronics 132. The power electronics 131 is associated with the motor controllers and high voltage feeds of the printing unit 110 or, if the transfer unit 120; the digital electronics 132 (for example a microprocessor controller) serves for realization of process regulations in cooperation with the central control group 400, advantageously the signal processing including the interface controller to sensors of the printing unit 110 or of the transfer unit 120.

The printing group 100 can additionally comprise an additional and auxiliary process unit 140 with an ink feed station 141 and/or with a printing substrate conditioner station 142 (advantageously for paper moistening) and/or with a filter and suction station 143 (advantageously for the developer station or for the corona device).

Finally, the printing group 100 comprises an image data processing unit 150 (a controller).

The developer station E of FIG. 4 comprises the following components:

a developer roller 203 with an elastic coating 206 a raster roller 202 with a rastering made up of depressions (cups) arranged thereupon; a plurality of raster rollers can also be provided; the rastering can be executed differently depending on the application case;

a doctor blade chamber 201 that is variable in terms of its position relative to the raster roller;

a cleaning device with a cleaning roller 204 and a cleaning element 205.

The developer roller 203 contacts an image carrier element F, for example a photoconductor on a photoconductor belt or a roller with a photoconductor layer arranged thereupon. The charge images that should be inked with toner particles are provided on the image carrier element F.

A liquid developer with ink (toner particles) distributed therein, which liquid developer is suitable for electrophoretic development, can be used for said inking as it is known, for example, from EP 0 756 213 B1 or EP 0 727 720 B1. The liquid developer is transported by the developer roller 203 through a developer gap existing between image carrier element F and developer roller 203. There the toner particles cross over onto the image carrier element F corresponding to the development method described above.

The feed of the liquid developer for inking with toner particles of the image carrier element F according to the image occurs over the doctor blade chamber 201 and the raster roller 202 to the developer roller 203. The cleaning of the inverse residual image from the developer roller 203 in turn occurs via its transfer to the cleaning roller 204 and removal of the liquid developer from the cleaning roller 204 via a cleaning element 205 (for example a doctor blade). From the cleaning device 204, 205, the removed liquid developer can be transferred back to a reservoir for the liquid developer (not shown).

The developer roller 203, the raster roller 202 and the cleaning roller 204 rotate in an advantageous manner with constant speed ratios relative to one another (surface velocities), advantageously in a ratio of 1:1:1. The rotation direction of the developer roller 203 and of the medium element F can be in the same direction or in opposite directions; directions of the developer roller 203 and of the raster roller 202 as well as of the developer roller 203 and of the cleaning roller 204 can be in the same direction or in opposite directions. Defined potentials for targeted field effect on the charged toner particles can be applied to them.

The developer roller 203 has an elastic coating 206 and is in contact with the image carrier element F, with the raster roller 202, and with the cleaning roller 204.

The raster roller 202 is realized in terms of its rastering for the transport of a volume (adapted to the speed of the image carrier element F) of liquid developer of, for example, 1 to 40 $cm^3/m^2$ (relative to the roller surface). The transport of liquid developer is relative to the area and thus independent of the printing speed; this means that, given different printing speeds, the same quantity of liquid developer per areal unit of the developer roller 203 can always be supplied.

The formation of defined effective zones for the transfer of liquid developer between developer roller 203 and image carrier element F, developer roller 203, and cleaning roller 204 and developer roller 203 and raster roller 202 can be achieved in various manners:

via defined deformation of the elastic coating 206 of the developer roller 203, advantageously via elastic force delivery to adjacent elements such as, for example image carrier element F, raster roller 202, or cleaning roller 204;

via the incompressible layer of the liquid developer between developer roller 203 and image carrier element F, developer roller 203 and cleaning roller 204, or developer roller 203 and raster roller 202.

The developed charge images on the image carrier element F are finally transferred onto a recording medium directly or via a transfer roller. This process can occur in a known manner, for example as it described in EP 0 727 720 B1.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim:

1. An electrographic printing device, comprising:

an image generating system that generates an electrical charge image on an image carrier element;

the electrical charge image being made visible by a developer station via charged toner particles of a liquid developer, said image being subsequently transferred onto a final image medium and fixed thereon; and a speed control which continuously varies speed of the image carrier element from 0 up to a limit speed, adapts charge intensity of the image carrier element to its speed, adapts an exposure intensity for exposure according to the image and adapts a deletion exposure of the image carrier element to its speed, and keeps a supply of toner to the image carrier element constant per area.

2. A printing device according to claim 1 in which the electrical charge images generation is adapted to the speed of the image carrier element with regard to information location and energy per area, such that in the electrographic process the charge image is always created in a same manner independent of the speed of the image carrier element.

3. A printing device according to claim 1 in which the developer station is designed such that a signal distribution on the image carrier element is developed independent of its speed, such that during development identical potential distributions on the image carrier element always generate same toner distributions on the charge images.

4. A printing device according to claim 3 in which process parameters are variable when development of the charge image is not independent of the speed of the image carrier element, so that toner image deposition on the image carrier element is identical at different speeds.

5. A printing device according to claim 1 in which process parameters are variable when transfer of the toner image onto the final image medium directly or via an intermediate carrier is not independent of the speed of the image carrier element, so that the toner image deposition on the image carrier element is identical at different speeds.

6. A printing device according to claim 4 in which the process parameters to be influenced are coupled with one another via one or more regulatory processes.

7. A printing device according to claim 1 in which inking of the image medium by the developer station occurs according to electrophoresis.

8. A printing device according to claim 7 in which a developer roller is provided in the developer station, the developer roller transporting a liquid developer past the image carrier element such that toner deposition in the image carrier element is independent of its speed.

9. A printing device according to claim 8 in which a high-ohmic carrier fluid in which toner particles are dispersed is provided as a liquid developer.

10. A printing device according to claim 9 in which the carrier fluid comprises silicon oil.

11. A printing device according to claim 9 in which the toner particles advantageously exhibit a diameter of approximately 1 μm.

12. A printing device according to claim 1 in which toner concentration in the liquid developer is selected such that so many toner particles are located in a developer gap between a developer roller and the image carrier element such that all toner particles located in the developer gap create a desired inking of the charge images given complete deposition.

13. A printing device according to claim 12 in which the developer gap is from 5 to 10 μm.

14. A printing device according to claim 12 in which a mobility of the toner particles in the developer gap is such that, during the residence duration of the toner particles in the developer gap, all toner particles under influence of an electrical field strength existing over the image carrier element to be inked traverse the developer gap and are deposited on a surface of the image carrier element to be inked.

15. A printing device according to claim 1 wherein the developer station comprises:

a developer roller arranged adjacent to the image carrier element, the developer roller directing liquid developer comprising the toner particles past the image carrier element and from the developer roller toner particles cross over to the image carrier element corresponding to the previously-generated charge images, a raster roller arranged adjacent to the developer roller, a raster of the raster roller transporting the liquid developer to the developer roller, and a doctor blade chamber comprising a dosing doctor blade arranged adjacent to the raster roller, from the chamber doctor blade the raster roller accepts the liquid developer via the dosing doctor blade, a position of the chamber doctor blade being adjustable relative to the raster roller, and the doctor blade chamber being designed such that the dosing doctor blade is overflowed by liquid developer.

16. A printing device according to claim 15 in which the chamber doctor blade is arranged relative to the raster roller such that the dosing doctor blade is washed over by liquid developer due to gravity.

17. A printing device according to claim 15 in which the liquid developer in the chamber doctor blade is exposed to an over-pressure such that the dosing doctor blade is washed over by liquid developer.

18. A printing device according to claim 15 in which a cleaning device is arranged adjacent to the developer roller for removal from the developer roller of the liquid developer comprising an inverse residual image, the cleaning device accepting the residual image.

19. A printing device according to claim 18 in which the cleaning device comprises a cleaning roller and a cleaning element that strips the liquid developer from the cleaning roller.

20. A printing device according to claim 19 in which the developer roller, the raster roller and the cleaning roller rotate with constant speed ratios.

21. A printing device according to claim 20 in which the developer roller, the raster roller, and the cleaning roller rotate in a ratio of 1:1:1.

22. A printing device according to claim 19 in which the developer roller comprises an elastic coating that is in contact with the image carrier element, with the raster roller, and with the cleaning roller.

23. A printing device according to claim 15 in which the transport of the liquid developer by the raster roller is relative to an area and thus independent of the printing speed, so that a same quantity of liquid developer per unit of area is always directed to the developer roller given different printing speeds.

24. A printing device according to claim 23 in which a quantity of the liquid developer transported by the raster roller is established by the raster of the raster roller.

25. A printing device according to claim 24 in which the raster roller exhibits a raster that enables a transport of a volume of the liquid developer from 1 to 40 $cm^3/m^2$.

26. A printing device according to claim 15 in which the chamber doctor blade comprises a chamber situated on a circumferential surface of the raster roller, a closing doctor blade being at an entrance of the chamber as viewed in a rotation direction of the raster roller and the dosing doctor blade being at an exit of the chamber as viewed in the rotation direction of the raster roller to seal the chamber by providing seals laterally situated on an edge of the raster roller.

27. A printing device according to claim 26 in which a feed of the liquid developer into the chamber occurs via one or more inlet openings.

28. A printing device according to claim 26 in which a removal of the liquid developer from the chamber occurs via outlet openings.

29. A method for operation of an electrophotographic printing device with variable printing speed, comprising the steps of:

providing an image generating system for generating an electrical charge image on an image carrier element;

providing a developer station for making the electrical charge image visible via charged toner particles;

transferring said image onto a final image medium and fixing it thereon;

providing a speed control; and with the speed control continuously varying speed of the image carrier element from zero up to a limit speed, adapting charge intensity of the image carrier element to its speed, adapting exposure intensity for exposure according to the image and adapting a deletion exposure of the image carrier element to its speed, and keeping a supply of toner to the image carrier element constant per area.

30. A method according to claim 29 in which the electrical charge image generation is adapted to the speed of the image carrier element such that in the electrographic process, the charge image is always created in a same manner independent of the speed of the image carrier element.

31. A method according to claim 29 in which the charge intensity is adapted to the speed of the image carrier element.

32. A method according to claim 29 in which the developer station is designed such that a signal distribution on the image carrier element is developed independent of its speed, such that during development identical potential distributions on the image carrier element always generate same toner distributions on the charge images.

33. A method according to claim 32 in which process parameters are varied when development of the charge image is not independent of the speed of the image carrier element, such that toner image deposition is identical given different speeds of the image carrier element.

34. A method according to claim 29 in which process parameters are varied when the transfer of the toner image onto the final image medium directly or via an intermediate carrier is not independent of the speed of the image carrier element, such that the toner image deposition on the final image medium is identical at different speeds.

35. A method according to claim 33 in which the process parameters to be influenced are coupled with one another via a regulatory process or a plurality of regulatory processes.

36. A method according to claim 29 in which the images on the image carrier element are developed according to an electrophoretic principle.

37. A method according to claim 36 in which a developer roller in the developer station transports a liquid developer past the image carrier element such that toner deposition in the image carrier element is independent of its speed.

38. A method according to claim 37 in which the toner concentration in the liquid developer is selected such that so many toner particles are located in a developer gap between the developer roller and the image carrier element that a desired inking of the charge images is created given complete deposition of all toner particles located in the developer gap.

39. A method according to claim 37 in which a mobility of the toner particles in the developer gap is such that, during a residence duration of the toner particles in the developer gap, all toner particles under influence of an electrical field strength existing over the image carrier element to be inked traverse the developer gap and are deposited on a surface of the image carrier element to be inked.

40. An electrographic printing device, comprising:

an image generating system that generates an electrical charge image on an image carrier element;

the electrical charge image being made visible by a developer station via charged toner particles, said image being subsequently transferred onto an image medium and fixed thereon; and a speed control which varies speed of the image carrier element from 0 up to a limit speed, adapts charge intensity of the image carrier element to its speed, adapts an exposure intensity for exposure according to the image and adapts a deletion exposure of the image carrier element to its speed, and keeps a supply of toner to the image carrier element constant per area.

* * * * *